US010320129B2

(12) United States Patent
Ramunno

(10) Patent No.: US 10,320,129 B2
(45) Date of Patent: Jun. 11, 2019

(54) LOW PROFILE TERMINAL ASSEMBLY

(71) Applicant: AEES Inc., Farmington Hills, MI (US)

(72) Inventor: David A. Ramunno, Milford, MI (US)

(73) Assignee: AEES, INC., Farmington Hills, MI (US)

( * ) Notice: Subject to any disclaimer, the term of this patent is extended or adjusted under 35 U.S.C. 154(b) by 0 days.

(21) Appl. No.: 15/557,659

(22) PCT Filed: Mar. 12, 2015

(86) PCT No.: PCT/US2015/020143
§ 371 (c)(1),
(2) Date: Sep. 12, 2017

(87) PCT Pub. No.: WO2016/144358
PCT Pub. Date: Sep. 15, 2016

(65) Prior Publication Data

US 2018/0076575 A1 Mar. 15, 2018

(51) Int. Cl.
*H01R 13/688* (2011.01)
*H01R 11/12* (2006.01)
(Continued)

(52) U.S. Cl.
CPC ..... *H01R 13/688* (2013.01); *H01R 11/287* (2013.01); *H01R 13/5202* (2013.01);
(Continued)

(58) Field of Classification Search
CPC ..... H01R 13/688; H01R 13/5202; H01R 13/5213; H01R 31/00; H01R 11/287; H01R 4/184; H01R 2101/00; H01R 11/12
(Continued)

(56) References Cited

U.S. PATENT DOCUMENTS 2,204,948 A * 6/1940 Pond ..... H01H 85/0452 337/226
4,199,214 A 4/1980 Pearce, Jr. et al.
(Continued)

FOREIGN PATENT DOCUMENTS

CN 2443486 Y 8/2001
CN 1684215 A 10/2005
(Continued)

OTHER PUBLICATIONS

International Search Report for PCT/US2015/020143; dated Jun. 26, 2015; 9 pages.
(Continued)

*Primary Examiner* — Anatoly Vortman
(74) *Attorney, Agent, or Firm* — Howard & Howard Attorneys PLLC

(57) ABSTRACT

A terminal assembly for serviceably housing an electrical fuse includes a first terminal having a mounting end and a first fuse contacting end with the mounting end adapted for receiving a stud, a second terminal having a wire contacting end and a second fuse contacting end with the wire contacting end adapted for receiving an electrical cable, and a terminal housing securing the first terminal and the second terminal together, the terminal housing defining a cavity adapted for receiving a fuse, wherein the first fuse contacting end of the first terminal and the second fuse contacting end of the second terminal extend into the cavity, and wherein the fuse is adapted to be inserted into the cavity and is disposed atop the first terminal and the second terminal without requiring disassembly or alteration of the terminal assembly.

20 Claims, 5 Drawing Sheets

(51) Int. Cl.
*H01R 4/18* (2006.01)
*H01R 13/52* (2006.01)
*H01R 31/00* (2006.01)
*H01R 11/28* (2006.01)
*H01R 101/00* (2006.01)

(52) U.S. Cl.
CPC ..... *H01R 13/5213* (2013.01); *H01R 31/00* (2013.01); *H01R 4/184* (2013.01); *H01R 11/12* (2013.01); *H01R 2101/00* (2013.01)

(58) Field of Classification Search
USPC ..... 337/187
See application file for complete search history.

(56) References Cited

U.S. PATENT DOCUMENTS 4,218,109 A 8/1980 Kneusels
4,280,748 A 7/1981 McHenney et al.
4,391,485 A * 7/1983 Urani ..... H01H 85/2035 337/198
4,648,674 A * 3/1987 Sanchez, Jr. ..... H01H 85/201 439/395
4,830,631 A * 5/1989 Hsueh ..... H01H 85/201 337/187
4,836,802 A * 6/1989 Phillips ..... H01H 85/2035 337/187
4,997,394 A * 3/1991 Katz ..... H01H 85/201 337/186
5,088,940 A * 2/1992 Saito ..... H01H 85/205 439/620.34
5,645,448 A 7/1997 Hill
5,752,856 A 5/1998 Boutin et al.
5,805,047 A 9/1998 De Villeroche et al.
5,825,274 A * 10/1998 Totsuka ..... H01H 85/0417 337/190
5,841,337 A * 11/1998 Douglass ..... H01H 85/0452 337/198
5,929,739 A * 7/1999 Totsuka ..... H01H 85/0417 337/190
6,050,856 A * 4/2000 Sugiura ..... H01H 85/205 439/620.27
6,162,098 A * 12/2000 Cheng ..... H01R 13/68 439/620.29
6,165,020 A * 12/2000 Cheng ..... H01H 85/2035 439/620.26
6,283,794 B1 * 9/2001 Osuga ..... H01R 4/184 439/620.05
6,294,978 B1 * 9/2001 Endo ..... H01H 85/044 337/159
6,512,443 B1 * 1/2003 Matsumura ..... H01H 85/044 337/161
6,607,860 B2 8/2003 Hulbert et al.
6,666,722 B2 * 12/2003 Fukumori ..... H01H 85/2035 439/620.26
6,726,506 B2 * 4/2004 Fukumori ..... H01H 85/2035 361/767
6,784,783 B2 * 8/2004 Scoggin ..... H01H 85/547 337/194
6,855,008 B1 2/2005 Freitag et al.
6,932,650 B1 8/2005 Freitag
7,046,115 B2 * 5/2006 Higuchi ..... H01H 85/044 337/193
7,192,319 B1 * 3/2007 Rahman ..... H01H 85/044 439/766
7,292,130 B2 * 11/2007 Taga ..... H01H 85/044 337/159
7,377,813 B2 * 5/2008 Pentell ..... H01H 85/2015 439/620.26
7,413,488 B2 8/2008 Matsumura
7,772,959 B2 * 8/2010 Cheng ..... H01H 85/201 337/241
7,802,998 B2 * 9/2010 Taguchi ..... H01R 4/305 439/76.2
7,924,136 B2 4/2011 Darr et al.
7,924,137 B2 * 4/2011 Rahman ..... H01H 85/044 337/158
7,948,353 B2 * 5/2011 Deno ..... H01H 85/547 337/187
8,242,874 B2 * 8/2012 Pavlovic ..... H01H 85/153 337/187
8,638,188 B2 * 1/2014 Iwata ..... G01R 1/0408 337/186
9,384,929 B2 * 7/2016 Masuda ..... H01H 85/0241
9,425,018 B2 * 8/2016 Nohara ..... H01H 85/201
9,589,756 B2 * 3/2017 Saimoto ..... H01H 85/2035
2003/0179070 A1 * 9/2003 Izumi ..... H01H 85/201 337/255
2004/0192113 A1 * 9/2004 Yamashita ..... H01R 13/6456 439/620.34
2005/0237147 A1 * 10/2005 Carreras ..... H01H 85/2045 337/186
2005/0275499 A1 * 12/2005 Kita ..... H01H 85/0417 337/186
2006/0003627 A1 1/2006 Freitag
2008/0242150 A1 * 10/2008 Chikamatsu ..... H01H 85/0208 439/620.3
2009/0309689 A1 12/2009 Pavlovic et al.
2011/0306243 A1 * 12/2011 Shiraki ..... H01R 11/287 439/620.29

FOREIGN PATENT DOCUMENTS

CN 102157279 A 8/2011
EP 2533363 A1 12/2012
JP 200787823 A 4/2007
WO 2005029646 A2 3/2005

OTHER PUBLICATIONS

English language abstract of JP200787823; downloaded from espacenet.com on Sep. 13, 2017; 22 pages.
European Search Report for Application EP15884877 dated Oct. 1, 2018, 2 pages.
English language abstract for CN2443486Y extracted from espacenet.com database on Jan. 17, 2019, 1 page.
Computer-generated English language translation for CN1684215A extracted from espacenet.com database on Jan. 17, 2019, 12 pages.
English language abstract for CN102157279A extracted from espacenet.com database on Jan. 17, 2019, 2 pages.
Chinese Search Report for Application CN2015800798476 dated Nov. 5, 2018, 5 pages.

* cited by examiner

LOW PROFILE TERMINAL ASSEMBLY

CROSS-REFERENCE TO RELATED APPLICATIONS

The present application is the National Stage of International Patent Application No. PCT/US2015/020143, filed on Mar. 12, 2015, which is hereby expressly incorporated herein by reference in its entirety.

BACKGROUND OF THE INVENTION

1. Field of the Invention

The present invention relates generally to terminal assemblies for vehicles and, more particularly to, a low profile terminal assembly for holding a fuse for a vehicle.

2. Description of the Related Art

It is known to provide a fuse holder for a removable electrical fuse. The fuse holder typically is in-line with a wire connected to a load and an unprotected wire connected to an eyelet, which is connected to a terminal of a battery. The fuse holder includes a housing and a cover pivotally attached to the housing, and configured to carry the electrical fuse. The fuse electrically interconnects the wires.

One disadvantage of the above fuse holder is that the fuse holder is spliced into the wiring harness and/or the electrical cable. Another disadvantage of the above fuse holder is that there is an unprotected wire between the fuse holder and the terminal for connection to the battery. Therefore, there is a need in the art to provide a new terminal assembly coupled to an electrical cable for engaging an electrical component to hold a fuse without requiring disassembly or alteration of the terminal assembly.

SUMMARY OF THE INVENTION

Accordingly, the present invention provides a terminal assembly for serviceably housing an electrical fuse. The terminal assembly includes a first terminal having a mounting end and a first fuse contacting end with the mounting end adapted for receiving a stud, a second terminal having a wire contacting end and a second fuse contacting end with the wire contacting end adapted for receiving an electrical cable, and a terminal housing securing the first terminal and the second terminal together. The terminal housing defines a cavity adapted for receiving a fuse. The first fuse contacting end of the first terminal and the second fuse contacting end of the second terminal extend into the cavity. The fuse is adapted to be inserted into the cavity and is disposed atop the first terminal and the second terminal without requiring disassembly or alteration of the terminal assembly.

One advantage of the present invention is that a new terminal assembly is provided for a vehicle that holds an electrical fuse therein. Another advantage of the present invention is that the terminal assembly is coupled to an electrical cable to hold an electrical fuse for engaging an electrical component. Yet another advantage of the present invention is that the terminal assembly does not require added splices to integrate into a wire harness. Still another advantage of the present invention is that the terminal assembly holds an electrical fuse without requiring disassembly or alteration of the terminal assembly. A further advantage of the present invention is that the terminal assembly serviceably houses slow blow cartridge type electrical fuses having a low profile configuration. Yet a further advantage of the present invention is that the terminal assembly holds an electrical fuse and is secured by a stud. Still a further advantage of the present invention is that the terminal assembly eliminates an unprotected "up stream" wire. Another advantage of the present invention is that the terminal assembly is smaller and less expensive than some fuse holders.

Other features and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
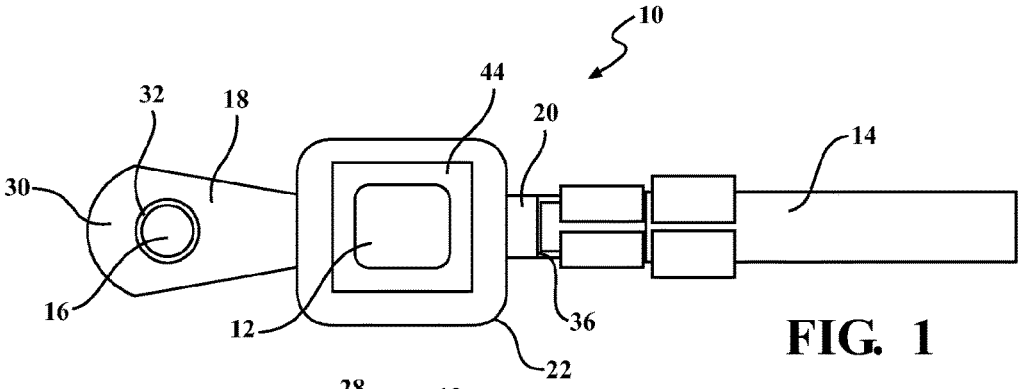
FIG. 1 is a plan view of a low profile terminal assembly, according to one embodiment of the present invention.
Figure 2:
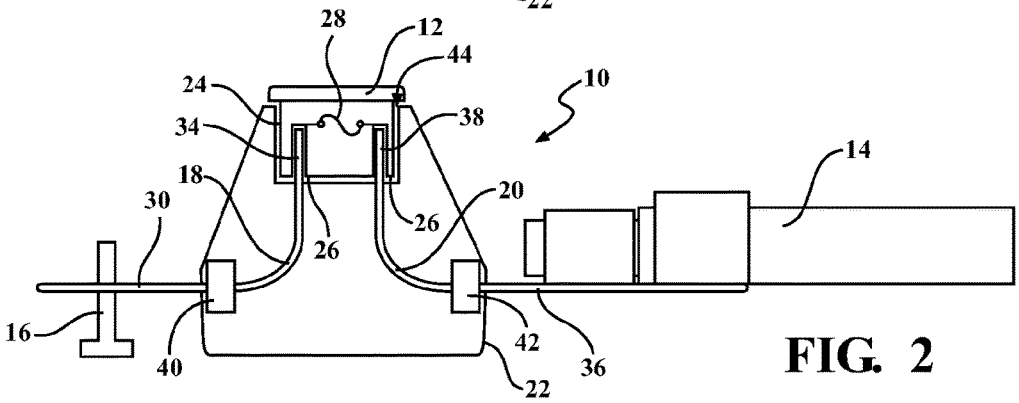
FIG. 2 is a fragmentary elevational view of the low profile terminal assembly of FIG. 1.
Figure 3:
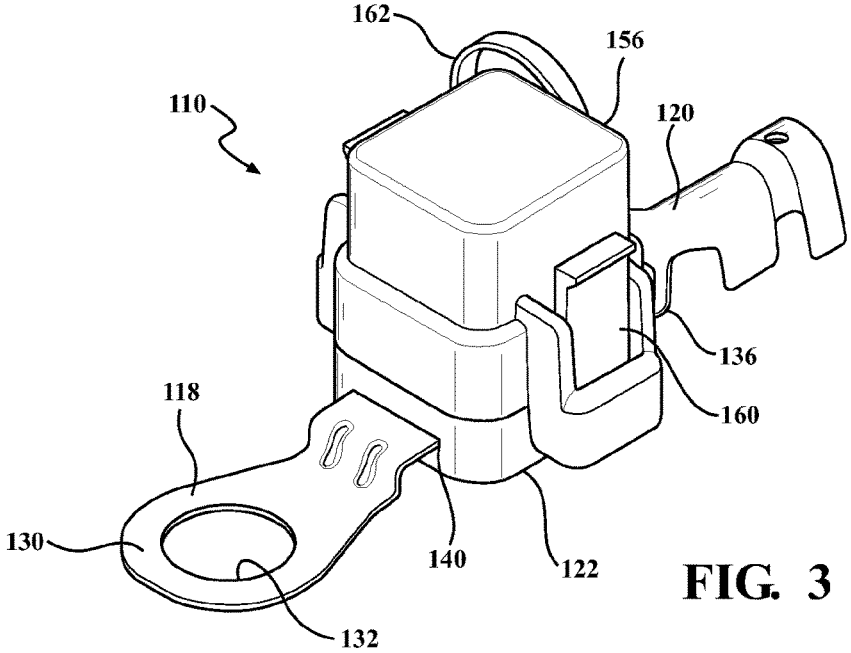
FIG. 3 is a perspective view of another embodiment, according to the present invention, of the low profile terminal assembly of FIGS. 1 and 2.
Figure 4:
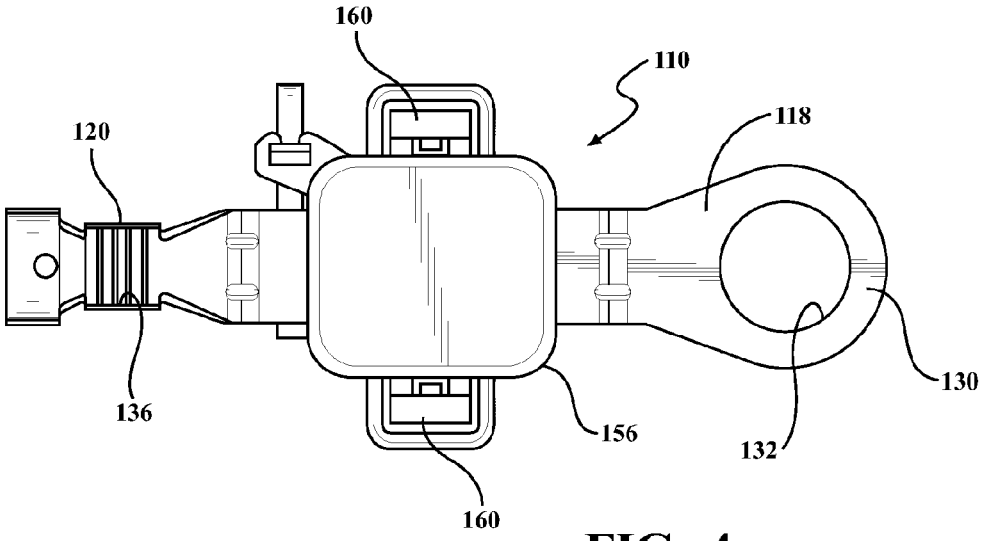
FIG. 4 is plan view of the low profile terminal assembly of FIG. 3.
Figure 5:
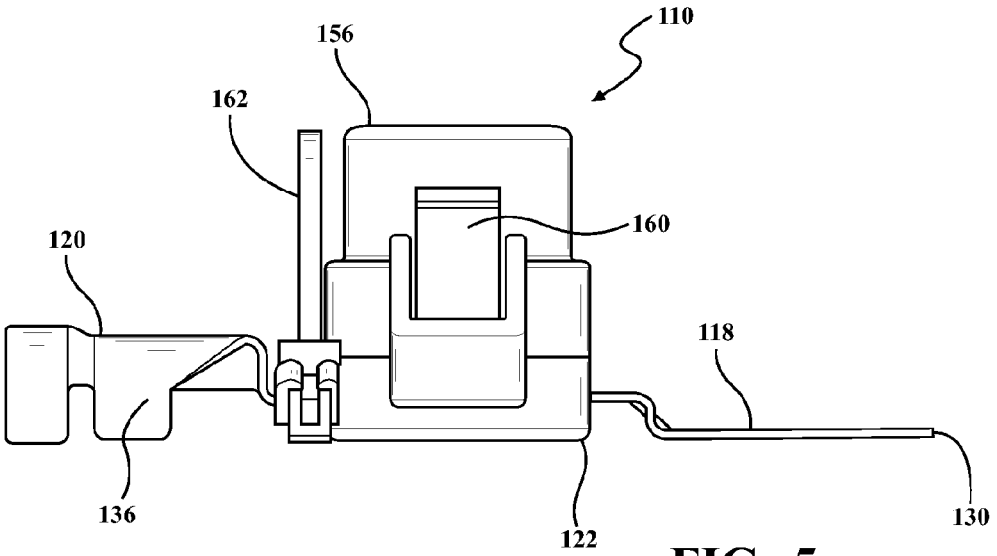
FIG. 5 is an elevational view of the low profile terminal assembly of FIG. 3.
Figure 6:
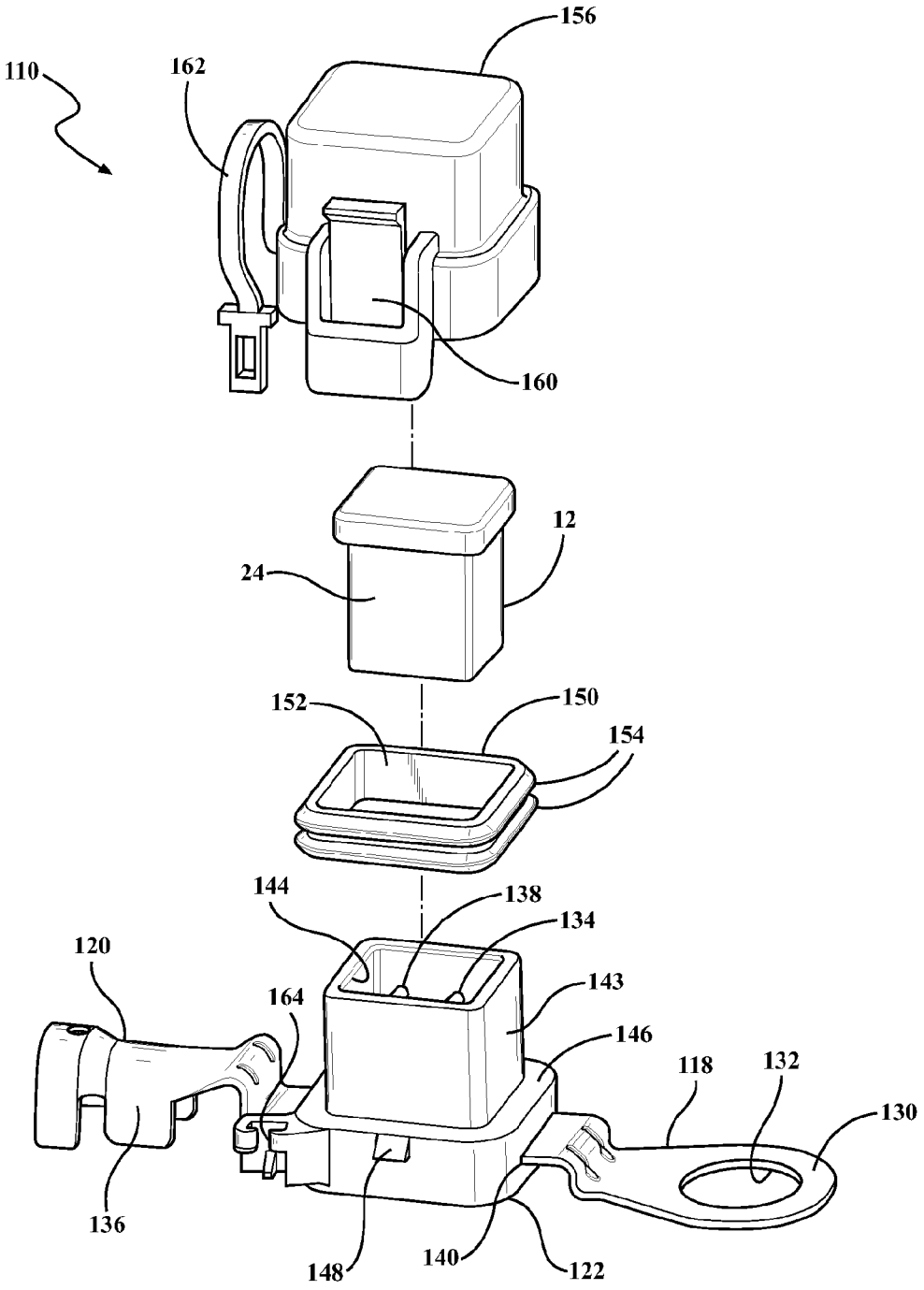
FIG. 6 is an exploded view of the low profile terminal assembly of FIG. 3.

As disclosed in the FIGS. 1 and 2, one embodiment of a low profile terminal assembly 10, according to the present invention, is shown for serviceably housing an electrical fuse 12. In one embodiment, the terminal assembly 10 is coupled between an electrical cable 14 and an energized power stud 16 extending from an electrical component (not shown) of a vehicle (not shown), such as an alternator or battery. It should be appreciated that the terminal assembly 10 may be used in other embodiments for the vehicle other than the electrical cable 14 and stud 16.

As illustrated in FIGS. 1 and 2, the terminal assembly 10 includes a first terminal 18 for coupling the terminal assembly 10 to the stud 16 and a second terminal 20 for coupling the terminal assembly 10 to the electrical cable 14. The terminal assembly 10 further includes a terminal housing 22 for securing the first and second terminals 18, 20 together and for receiving the fuse 12. It should be appreciated that the terminals 18, 20, as illustrated, extend in opposite directions from the terminal housing 22.

The fuse 12 includes a fuse housing 24 having a pair of fuse terminals 26 and a fuse element 28 disposed therein. The fuse housing 24 is generally rectangular in shape, but may have any suitable shape. The fuse terminals 26 extend generally parallel from the fuse housing 24. The pair of fuse terminals 26 electrically couple the fuse element 28 between the first and second terminals 18, 20 as the fuse 12 is inserted into the terminal housing 22. The fuse terminals 26 are made of an electrically conductive material such as metal. It should be appreciated that the fuse 12 is preferably a slow blow cartridge type having a low-profile configuration.

The first terminal 18 includes a mounting end 30 having an aperture 32 for receiving the stud 16. The aperture 32 may be open ended, generally circular in shape, or may have any suitable shape. If the aperture 32 is closed, i.e. circular, then the mounting end 30 could be in the shape of an eyelet. The first terminal 18 also includes a first fuse contacting end 34 for coupling the first terminal 18 to one of the fuse terminals 26. In the embodiment illustrated, the first terminal 18 has a substantially L-shaped configuration such that an angle defined between the mounting end 30 and the first fuse contacting end 34 is approximately 90 degrees. In another embodiment, the first terminal 18 has a straight configuration between the mounting end 30 and the first fuse contacting end 34. In other embodiments, the first terminal 18 may have a multiple bend configuration between the mounting end 30 and the first fuse contacting end 34 to allow for various orientations. The mounting end 30 is directly connected to the first fuse contacting end 34. The first terminal 18 is made of an electrically conductive material such as metal. It should be appreciated that the first fuse contacting end 34 is generally planar. It should also be appreciated that the mounting end 30 of the first terminal 18 is directly adjacent the terminal housing 22.

The second terminal 20 includes a wire contacting end 36 for coupling the second terminal 20 to the electrical cable 14. The wire contacting end 36 is generally arcuate in shape for receiving the electrical cable 14. The second terminal 20 also includes a second fuse contacting end 38 for coupling the second terminal 20 to the other one of the fuse terminals 26. The second terminal 20 has a substantially L-shaped configuration such that an angle defined between the wire contacting end 36 and the second fuse contacting end 38 is approximately 90 degrees. The second terminal 20 is made of an electrically conductive material such as metal. The second fuse contacting end 38 is generally planar. It should be appreciated that the wire contacting end 36 is secured to the electrical cable 14 by a suitable mechanism such as crimping or welding.

The terminal housing 22 includes a first slot 40 for receiving the first terminal 18 and a second slot 42 for receiving the second terminal 20. The terminal housing 22 also includes a cavity portion 43 defining a cavity 44 for receiving the fuse 12. The first terminal 18 is disposed through the first slot 40 such that the first fuse contacting end 34 extends into the cavity 44. The second terminal 20 is disposed through the second slot 42 such that the second fuse contacting end 38 extends into the cavity 44. The first terminal 18 is spaced from the second terminal 20 while disposed within the terminal housing 22 such that the first and second terminals 18, 20 are electrically disconnected when the fuse 12 is not installed. Within the cavity 44, the first fuse contacting end 34 is disposed substantially parallel to the second fuse contacting end 38. Furthermore, the mounting end 30 of the first terminal 18 is substantially planar with the wire contacting end 36 of the second terminal 20. It should be appreciated that first fuse contacting end 34 is spaced from the second fuse contacting end 38 with the first fuse contacting end 34 and second fuse contacting end 38 being adapted to be electrically connected solely through the fuse 12.

The terminal housing 22 is generally rectangular in shape, but may be any suitable shape. The terminal housing 22 is made of a non-conductive material such as plastic. The terminal housing 22 may be formed as integral, unitary, and one-piece or as two pieces snapped together. In one embodiment, the terminal housing 22 is molded over the first terminal 18 and second terminal 20. It should be appreciated that the terminal housing 22 is typically molded by injection molding, but may be molded by any suitable process.

In operation of the terminal assembly 10, the fuse 12 is inserted into the cavity 44 of the terminal housing 22 and is disposed atop the first and second terminals 18, 20. Specifically, as the fuse 12 enters the cavity 44, the pair of fuse terminals 26 electrically couple to the first and second fuse contacting ends 34, 38. As such, electrical current may pass between the first and second terminals 18, 20 because the fuse 12 electrically connects the first and second terminals 18, 20 through the fuse element 28. It should be appreciated that the fuse 12 is secured within the cavity 44 of the terminal housing 22 by a suitable mechanism such as a friction fit.

Referring to FIGS. 3 through 6, another embodiment, according to the present invention, of the terminal assembly 10 is shown. Like parts of the terminal assembly 10 have like reference numerals increased by one hundred (100). As illustrated in FIGS. 3 through 6, the terminal assembly 110 includes a first terminal 118 for coupling the terminal assembly 110 to the stud 16 and a second terminal 120 for coupling the terminal assembly 110 to the electrical cable 14. The terminal assembly 110 also includes a terminal housing 122 for securing the first and second terminals 118, 120 together and for receiving the fuse 12. It should be appreciated that the terminals 118, 120, as illustrated, extend in opposite directions from the terminal housing 22.

The first terminal 118 includes a mounting end 130 having an aperture 132 for receiving the stud 16. The aperture 132 may be open ended, generally circular in shape, or may have any suitable shape. If the aperture 132 is closed, i.e. circular, then the mounting end 130 could be in the shape of an eyelet. The first terminal 118 also includes a first fuse contacting end 134 for coupling the first terminal 118 to one of the fuse terminals 26. In the embodiment illustrated, the first terminal 118 has a substantially L-shaped configuration such that an angle defined between the mounting end 130 and the first fuse contacting end 134 is approximately 90 degrees. In another embodiment, the first terminal 118 has a straight configuration between the mounting end 130 and the first fuse contacting end 134. In other embodiments, the first terminal 118 may have a multiple bend configuration between the mounting end 130 and the first fuse contacting end 134 to allow for various orientations. The mounting end 130 is directly connected to the first fuse contacting end 134. The first terminal 118 is made of an electrically conductive material such as metal. It should be appreciated that the first fuse contacting end 134 is generally planar. It should also be appreciated that the mounting end 130 of the first terminal 118 is directly adjacent the terminal housing 122.

The second terminal 120 includes a wire contacting end 136 for coupling the second terminal 120 to the electrical cable 14. The wire contacting end 136 is generally arcuate in shape for receiving the electrical cable 14. The second terminal 120 also includes a second fuse contacting end 138 for coupling to the second terminal 120 to the other one of the fuse terminals 26. The second terminal 120 has a substantially L-shaped configuration such that an angle defined between the wire contacting end 136 and the second fuse contacting end 138 is approximately 90 degrees. The second terminal 120 is made of an electrically conductive material such as metal. The second fuse contacting end 138 is generally planar. It should be appreciated that the wire contacting end 136 is secured to the electrical cable 14 by a suitable mechanism such as crimping or welding.

The terminal housing 122 includes a first slot 140 for receiving the first terminal 118 and a second slot 142 for receiving the second terminal 120. The terminal housing 122 also includes a cavity portion 143 defining a cavity 144 for receiving the fuse 12. The terminal housing 22 further includes a flange 146 extending outwardly and a pair of protrusions 148 opposing one another and spaced below the flange 146. The first terminal 118 is disposed through the first slot 140 such that the first fuse contacting end 134 extends into the cavity 144. The second terminal 120 is disposed through the second slot 142 such that the second fuse contacting end 138 extends into the cavity 144. The first terminal 118 is spaced from the second terminal 120 while disposed within the terminal housing 122 such that the first and second terminals 118, 120 are electrically disconnected when the fuse 12 is not installed. Within the cavity 144, the first fuse contacting end 134 is disposed substantially parallel to the second fuse contacting end 138. Furthermore, the mounting end 130 of the first terminal 118 is substantially planar with the wire contacting end 136 of the second terminal 120. It should be appreciated that first fuse contacting end 134 is spaced from the second fuse contacting end 138 with the first fuse contacting end 134 and second fuse contacting end 38 being adapted to be electrically connected solely through the fuse 12.

The terminal housing 122 is generally rectangular in shape, but may be any suitable shape. The terminal housing 122 is made of a non-conductive material such as plastic. The terminal housing 122 may be formed as integral, unitary, and one-piece or as two pieces snapped together. In one embodiment, the terminal housing 122 is molded over the first terminal 118 and second terminal 120. It should be appreciated that the terminal housing 122 is typically molded by injection molding, but may be molded by any suitable process.

The terminal assembly 110 also includes a seal 150 disposed about the cavity portion 143 of the terminal housing 122. The seal 150 includes a ring shaped body 152 having a generally rectangular shape, but may be any suitable shape. The seal 150 has one or more ribs 154 extending outwardly from the body 152 and spaced from each other. The seal 150 is disposed about the cavity portion 143 of the terminal housing 122 and adjacent the flange 146. The seal 150 is made of an elastomeric material such that the ribs 154 flex to form a seal with a cover 156 to be described.

The terminal assembly 110 further includes a cover 156 cooperating with the terminal housing 122. The cover 156 is generally rectangular in shape, but may be any suitable shape, to be disposed over the cavity portion 143 of the terminal housing 122. The cover 156 has a cavity (not shown) to receive the cavity portion 143 of the terminal housing 122. The cover 156 has one or more latches 160 to removably secure the cover 156 to the terminal housing 122. In one embodiment, the latches 160 are disposed on opposed sides and are movable to engage and disengage the corresponding protrusions 148 on the terminal housing 122. The cover 156 may include a tether 162 that engages a recess 164 in the terminal housing 122 to keep the cover 156 attached to the terminal housing 122. It should be appreciated that the cover 156 is removable from the terminal housing 122 via the latches 160. It should also be appreciated that the ribs 154 of the seal 150 engage the inside of the cover 156.

In operation of the terminal assembly 110, the fuse 12 is inserted into the cavity 144 of the terminal housing 122 and is disposed atop the first and second terminals 118, 120. Specifically, as the fuse 12 enters the cavity 144, the pair of fuse terminals 26 electrically couple to the first and second fuse contacting ends 134, 138. The seal 150 is disposed about the cavity portion 143 of the terminal housing 122. The cover 156 is disposed over the cavity portion 143 of the terminal housing 122 and the latches 160 engage the protrusions 148 in the terminal housing 122 to secure the cover 156 to the terminal housing 122. It should be appreciated that electrical current may pass between the first and second terminals 118, 120 because the fuse 12 electrically connects the first and second terminals 118, 120 through the fuse element 28.

Figure 7:
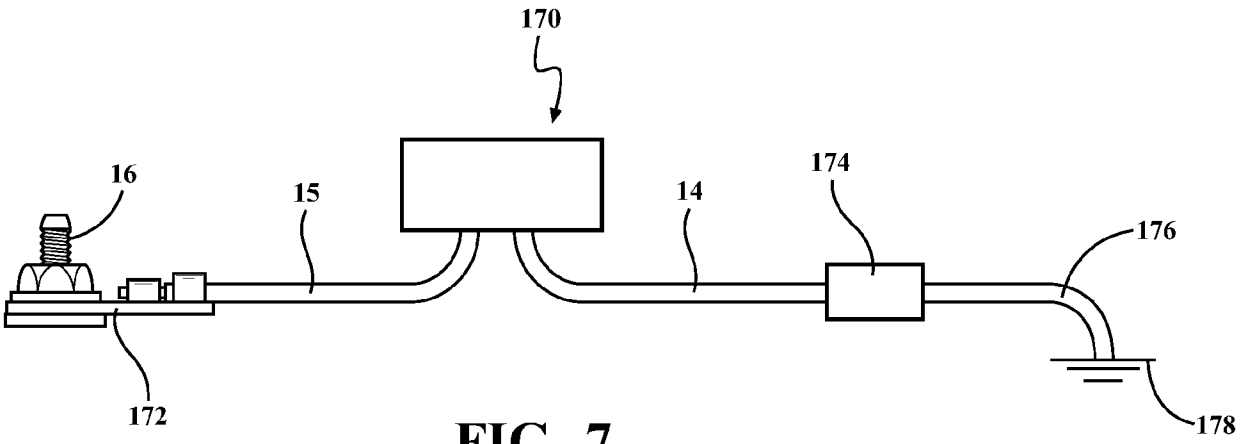
FIG. 7 PRIOR ART
FIG. 7 is diagrammatic view of a prior art in-line fuse holder illustrated in operational relationship with an energized power stud.

Referring to FIG. 7, a prior art in-line fuse holder 170 is generally shown for serviceably housing an electrical fuse (not shown). The fuse holder 170 is coupled between a first electrical cable 14 and a second electrical cable 15. The first electrical cable 14 is connected to a mounting 172 having an aperture (not shown) for receiving an energized power stud 16 extending from an electrical component (not shown) of a vehicle (not shown), such as an alternator or battery. The second electrical cable 15 is connected to a load 174 such as an electrical component of the vehicle. The load 174 is connected by an electrical ground wire 176 to ground 178 of the vehicle. It should be appreciated that current flows from the energized power stud 16 through the first electrical cable 14, in-line fuse holder 170, second electrical cable 15, the load 174, and ground wire 176 to ground 178. It should also be appreciated that the first electrical cable 14 is unprotected for the in-line fuse holder 170 is unprotected.

Figure 8:
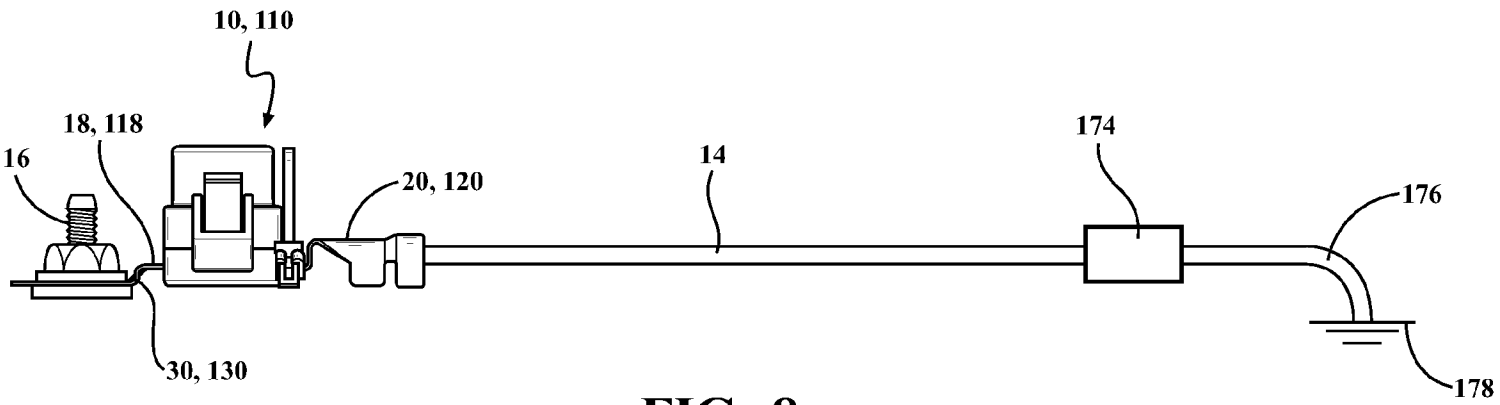
FIG. 8 a diagrammatic view of the low profile terminal assembly of FIGS. 1 and 2 illustrated in operational relationship with an energized power stud.

Referring to FIG. 8, the terminal assembly 10, 110 is generally shown for serviceably housing the electrical fuse 12 previously described. The terminal assembly 10, 110 includes the first terminal 18, 118 having the mounting end 30, 130 with an aperture 32, 132 for receiving the energized power stud 16 extending from an electrical component (not shown) of a vehicle (not shown), such as an alternator or battery. The terminal assembly 10, 110 includes the second terminal 120 connected to one end of the electrical cable 14. The electrical cable 14 has another end connected to the load 174 such as an electrical component of the vehicle. The load 174 is connected by the electrical ground wire 176 to ground 178 of the vehicle. It should be appreciated that current flows from the energized power stud 16 through the mounting end 30, 130, the terminal assembly 10, 110, the electrical cable 14, the load 174, and ground wire 176 to ground 178. It should also be appreciated that the terminal assembly 10, 110 eliminates an unprotected wire at the mounting end 30, 130.

Figure 9:
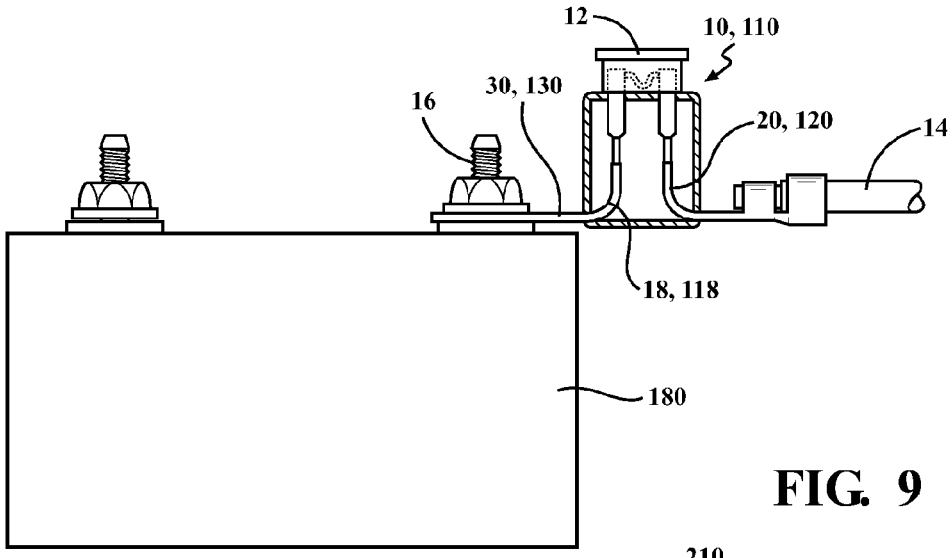
FIG. 9 is a fragmentary view of the low profile terminal assembly of FIGS. 1 and 2 illustrated in operational relationship with a power source.

Referring to FIG. 9, the terminal assembly 10, 110 is shown in operational relationship with a power source 180 such as a battery. The power source 180 includes the energized power stud 16. As illustrated, the first terminal 18, 118 and second terminal 20, 120 may be configured at approximately ninety degrees (90°). The first terminal 18, 118 has the mounting end 30, 130 connected to the energized power stud 16 and the second terminal 20, 120 is connected to the electrical cable 14. It should be appreciated that the terminal assembly 10, 110 houses the fuse 12.

Figure 10:
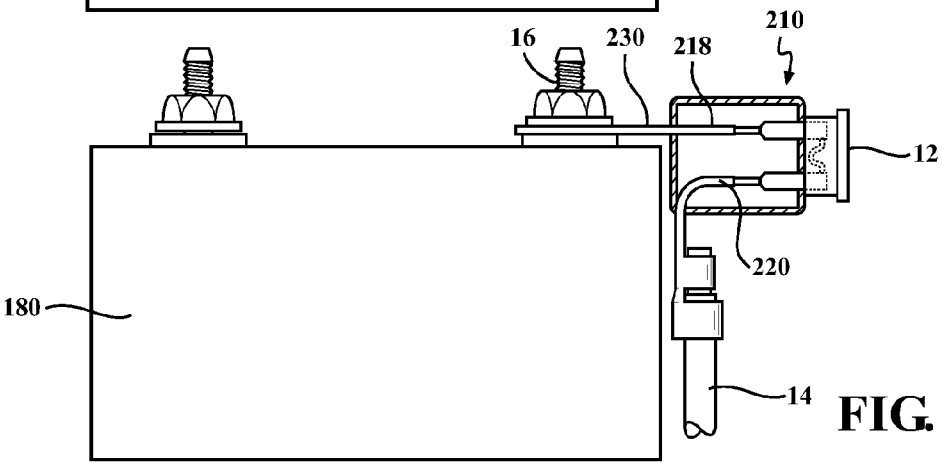
FIG. 10 is a fragmentary view of another embodiment, according to the present invention, of the low profile terminal assembly of FIGS. 1 and 2 illustrated in operational relationship with a power source.

Referring to FIG. 10, another embodiment, according to the present invention, of the terminal assembly 10, 110 is shown in operational relationship with a power source 180 such as a battery. The power source 180 includes the energized power stud 16. Like parts of the terminal assembly 10 have like reference numerals increased by two hundred (200) and like parts of the terminal assembly 110 have like reference numerals increased by one hundred (100). As illustrated, the terminal assembly 210 includes a first terminal 218 for coupling the terminal assembly 210 to the energized power stud 16 and a second terminal 220 for coupling the terminal assembly 210 to the electrical cable 14. As illustrated, the first terminal 218 may be straight and the second terminal 220 may be configured at approximately ninety degrees (90°). The first terminal 218 has the mounting end 230 connected to the energized power stud 16 and the second terminal 220 is connected to the electrical cable 14. It should be appreciated that the terminal assembly 210 houses the fuse 12.

Figure 11:
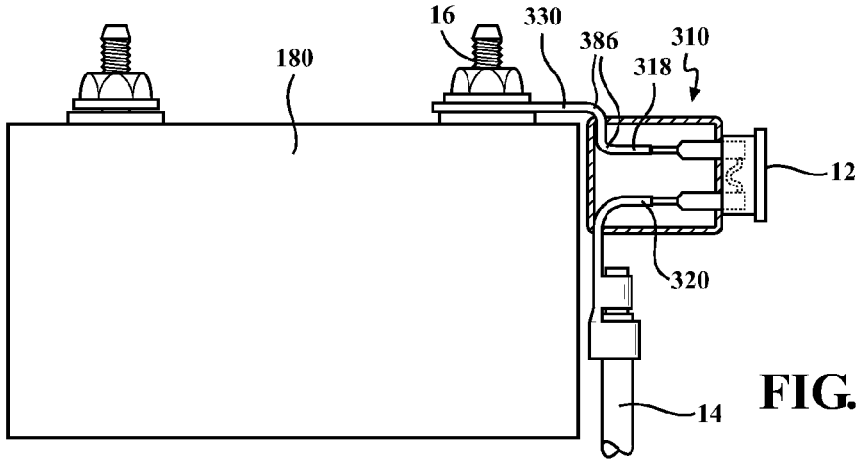
FIG. 11 is a fragmentary view of yet another embodiment, according to the present invention, of the low profile terminal assembly of FIGS. 1 and 2 illustrated in operational relationship with a power source.

Referring to FIG. 11, yet another embodiment, according to the present invention, of the terminal assembly 10, 110 is shown in operational relationship with a power source 180 such as a battery. The power source 180 includes the energized power stud 16. Like parts of the terminal assembly 10 have like reference numerals increased by three hundred (300) and like parts of the terminal assembly 110 have like reference numerals increased by two hundred (200). As illustrated, the terminal assembly 310 includes a first terminal 318 for coupling the terminal assembly 310 to the energized power stud 16 and a second terminal 320 for coupling the terminal assembly 310 to the electrical cable 14. As illustrated, the first terminal 318 may have one or more bends 386 to form a generally "Z" shaped configuration and the second terminal 320 may be configured at approximately ninety degrees (90°). The first terminal 318 has the mounting end 330 connected to the energized power stud 16 and the second terminal 320 is connected to the electrical cable 14. It should be appreciated that the terminal assembly 310 houses the fuse 12.

Accordingly, in the present invention, the terminal assembly 10, 110, 210, 310 advantageously provides circuit protection to the electrical cable 14 without requiring substantial manipulation of the electrical cable 14 to incorporate the fuse 12. Furthermore, the terminal assembly 10, 110, 210, 310 eliminates an unprotected wire at the mounting end 30, 130, 230, 330. It should be appreciated that the fuse 12 is readily accessible and components of the terminal assembly 10, 110, 210, 310 remain fixed and need not be altered to access and/or replace the fuse 12.

The present invention has been described in an illustrative manner. It is to be understood that the terminology, which has been used, is intended to be in the nature of words of description rather than of limitation.

Many modifications and variations of the present invention are possible in light of the above teachings. Therefore, the present invention may be practiced other than as specifically described.

What is claimed is:

1. A terminal assembly for serviceably housing an electrical fuse, said terminal assembly comprising:

a single electrical cable;

a first terminal having a mounting end and a first fuse contacting end with said mounting end adapted for receiving a stud;

a second terminal having a wire contacting end to directly receive said single electrical cable and a second fuse contacting end disposed at an angle relative to said wire contacting end with said wire contacting end receiving said electrical cable; and a terminal housing securing said first terminal and said second terminal together, said terminal housing defining a cavity adapted for receiving a fuse, wherein said first fuse contacting end of said first terminal and said second fuse contacting end of said second terminal extend into said cavity with said ends parallel to and facing each other and said mounting end of said first terminal and said wire contacting end of said second terminal remaining outside of said terminal housing, and wherein the fuse is adapted to be inserted into said cavity and is disposed atop said first terminal and said second terminal without requiring disassembly or alteration of said terminal assembly.

2. A terminal assembly as set forth in claim 1 wherein said first terminal has one of a substantially L-shaped configuration such that an angle defined between said mounting end and said first fuse contacting end is approximately 90 degrees.

3. A terminal assembly as set forth in claim 1 wherein said second terminal has a substantially L-shaped configuration such that the angle defined between said wire contacting end and said second fuse contacting end is approximately 90 degrees.

4. A terminal assembly as set forth in claim 1 wherein said terminal housing includes a first slot for receiving said first terminal and a second slot for receiving said second terminal.

5. A terminal assembly as set forth in claim 1 including a cover disposed over said terminal housing.

6. A terminal assembly as set forth in claim 5 wherein said cover includes a plurality of latches to removably secure said cover to said terminal housing.

7. A terminal assembly as set forth in claim 6 wherein said terminal housing includes a plurality of protrusions.

8. A terminal assembly as set forth in claim 7 wherein said cover has opposed sides and said latches are disposed on said opposed sides and are movable to engage and disengage said protrusions on said terminal housing.

9. A terminal assembly as set forth in claim 5 including a seal disposed between said cover and said terminal housing.

10. A terminal assembly as set forth in claim 9 wherein said seal has a body disposed about a portion of said terminal housing and at least one rib extending from said body to engage said cover.

11. A terminal assembly as set forth in claim 10 wherein said terminal housing has a flange extending outwardly and said seal is disposed adjacent said flange.

12. A terminal assembly as set forth in claim 1 wherein said first fuse contacting end is spaced from said second fuse contacting end with said first fuse contacting end and second fuse contacting end adapted to be electrically connected solely through the fuse.

13. A terminal assembly as set forth in claim 1 wherein said mounting end of said first terminal is directly adjacent said terminal housing.

14. A terminal assembly as set forth in claim 1 wherein said mounting end of said first terminal is directly connected to said first fuse contacting end.

15. A terminal assembly as set forth in claim 1 wherein said first terminal has a substantially straight configuration such that an angle defined between said mounting end and said first fuse contacting end is approximately 0 degrees.

16. A terminal assembly as set forth in claim 1 wherein said first terminal has a multiple bend configuration such that an angle defined between said mounting end and said first fuse contacting end is approximately 0 degrees.

17. A serviceable terminal assembly comprising:

a single electrical cable;

a first terminal having a mounting end and a first fuse contacting end with said mounting end adapted for receiving a stud;

a second terminal having a wire contacting end to directly receive said single electrical cable and a second fuse contacting end disposed at an angle relative to said wire contacting end with said wire contacting end receiving said electrical cable; and a terminal housing securing said first terminal and said second terminal together, said terminal housing defining a cavity, wherein said first fuse contacting end of said first terminal and said second fuse contacting end of said second terminal extend into said cavity with said ends parallel to and facing each other and said mounting end of said first terminal and said wire contacting end of said second terminal remaining outside of said terminal housing; and an electrical fuse inserted into said cavity and contacting said first fuse contacting end and said second fuse contacting end to electrically connect said first terminal and said second terminal solely through said fuse.

18. A serviceable terminal assembly as set forth in claim 17 including a cover disposed over said terminal housing.

19. A serviceable terminal assembly as set forth in claim 18 wherein said cover includes a plurality of latches to removably secure said cover to said terminal housing.

20. A serviceable terminal assembly as set forth in claim 18 including a seal disposed between said cover and said terminal housing.

* * * * *